US009283137B1

(12) United States Patent
White

(10) Patent No.: US 9,283,137 B1
(45) Date of Patent: Mar. 15, 2016

(54) PUSH LUGGAGE ASSEMBLY WITH A WALKER AND ATTACHED BAGS

(71) Applicant: Joan White, Philadelphia, PA (US)

(72) Inventor: Joan White, Philadelphia, PA (US)

( * ) Notice: Subject to any disclaimer, the term of this patent is extended or adjusted under 35 U.S.C. 154(b) by 0 days.

(21) Appl. No.: 14/801,733

(22) Filed: Jul. 16, 2015

(51) Int. Cl.
*A61H 3/04* (2006.01)
*A45C 9/00* (2006.01)
*A61H 3/00* (2006.01)

(52) U.S. Cl.
CPC .. *A61H 3/04* (2013.01); *A45C 9/00* (2013.01); *A45C 2009/005* (2013.01); *A61H 2003/002* (2013.01)

(58) Field of Classification Search
CPC ..... A61H 3/04; A61H 2003/002; A45C 9/00; A45C 2009/005
See application file for complete search history.

(56) References Cited

U.S. PATENT DOCUMENTS 4,346,912 A * 8/1982 Habib ..... 280/644
4,449,750 A * 5/1984 Pultman ..... 312/235.2
4,676,416 A * 6/1987 Harmon ..... 224/407
4,800,911 A * 1/1989 Endres et al. ..... 135/67
4,867,438 A * 9/1989 Steckert et al. ..... 482/68
4,974,760 A * 12/1990 Miller ..... 224/407
5,012,963 A * 5/1991 Rosenbaum ..... 224/407
D324,504 S * 3/1992 Olsen ..... D12/133
5,531,238 A * 7/1996 Azzarelli et al. ..... 135/66
5,901,891 A * 5/1999 Douglass ..... 224/407
6,099,002 A * 8/2000 Uchiyama ..... 280/87.021
D451,054 S * 11/2001 Thom et al. ..... D3/307
6,367,823 B1 * 4/2002 Miyagi ..... 280/47.34
6,401,996 B1 * 6/2002 Thom et al. ..... 224/407
6,651,994 B2 * 11/2003 Hallgrimsson et al. .. 280/87.041
7,001,313 B1 * 2/2006 Crnkovich ..... 482/68
7,163,020 B2 * 1/2007 Miyoshi ..... 135/67
7,252,296 B2 * 8/2007 Miyoshi ..... 280/37
7,984,724 B1 * 7/2011 Eberle ..... 135/67
8,186,367 B1 * 5/2012 Le tran et al. ..... 135/67
8,333,208 B2 * 12/2012 Miller ..... 135/67
8,602,185 B1 * 12/2013 White ..... 190/1
2004/0069335 A1 * 4/2004 Miyoshi ..... 135/67
2004/0231939 A1 * 11/2004 Miyoshi ..... 190/8
2005/0121481 A1 * 6/2005 Chiu ..... 224/407
2009/0183756 A1 * 7/2009 Perez ..... 135/67
2009/0188764 A1 * 7/2009 Miyoshi ..... 190/18 A
2010/0083994 A1 * 4/2010 Liu ..... 135/67
2010/0313924 A1 12/2010 Cho
2011/0030749 A1 * 2/2011 Miller ..... 135/67
2013/0061893 A1 * 3/2013 Nilsson et al. ..... 135/67
2014/0183831 A1 * 7/2014 Bin Mohd Din et al. ..... 280/30
2015/0173994 A1 * 6/2015 Chen ..... 280/647

* cited by examiner

*Primary Examiner* — Hau Phan
*Assistant Examiner* — Jacob Meyer
(74) *Attorney, Agent, or Firm* — LaMorte & Associates P.C.

(57) ABSTRACT

A push luggage assembly with a luggage bag and walker. The walker has a collapsible framework, wherein the walker has a first frame element, a second frame element and a flexible support panel that extends between the first frame element and the second frame element. The walker has folding leg elements that extend from the frame elements. Both the frame elements and the leg elements are supported by wheels. Travel bags are provided that are sized to attach to the walker. The travel bags engage the linkages that extend between the frame elements.

11 Claims, 5 Drawing Sheets

PUSH LUGGAGE ASSEMBLY WITH A WALKER AND ATTACHED BAGS

BACKGROUND OF THE INVENTION

1. Field of the Invention

In general, the present invention relates to hand carts and luggage carts that have folding features. The present invention also relates to the structure of collapsible walkers. More particularly, the present invention relates to assemblies that contain the features of both a luggage cart and a walker.

2. Prior Art Description

Many people benefit from the use of a walker as they walk. A walker provides physical support to a person so that a person can support his/her own weight with both their arms and their legs. This added support can prevent a person from falling if they mis-step or if their legs are otherwise unable to bear their full weight.

Although walkers are highly beneficial to many people, walkers do have some drawbacks. The primary drawback of a walker is that it is bulky. As such, a walker is very difficult to transport when it is not being used. Walkers are therefore difficult to move in and out of automobiles, restaurants seats and other confined spaces.

One of the most difficult places to use a walker is when boarding an airplane. Traditional walkers are large and bulky. As such, they are typically checked as luggage. However, if the walker is checked as luggage, it cannot be used to help a person board the airplane. As a consequence, people who otherwise could manage on their own with a walker are now required to be helped onto the airplane by airline employees who have a wheelchair. Rather than use a wheelchair, many people prefer to use a collapsible walkers. Collapsible walkers can be taken to the door of an airplane and checked with the flight crew in the same manner as a baby stroller.

In the prior art, there are many walker designs that are collapsible. Some of these designs may produce a walker small enough to check at the door of an airplane. However, another disadvantage of a walker is that a person must use both hands to grasp the walker. Therefore, if a person is using a walker, he/she has no free hand to carry or pull a carry-on bag. Accordingly, even if a walker is brought down a causeway to the door of an airplane, a user would not be able to bring anything other than the walker, since two hands are needed to grasp the walker.

In the prior art, people have recognized that the use of a walker prevents a person from carrying any secondary bag. This problem has been addressed in the prior art by adding carry bags to the frame of the walker. Such devices are disclosed in U.S. Patent No. 2010/0313924 to Cho, entitled Foldable Walker Apparatus. However, in order to keep the walker collapsible, the pockets have to be very thin and narrow. Accordingly, the pocket capacity of such designs are very small.

In U.S. Pat. No. 8,602,185, to White, the inventor herein, a walker is incorporated into the structure of a suitcase. Such an assembly is useful. However, such prior art devices require that a person travel with the bag that incorporates the walker. It also makes the travel bag heavier and bulkier than it need be if the walker is not being utilized.

A need therefore exists for a lightweight folding walker that can support a variety of carry travel bags as it is being utilized as a walker. In this manner, a person requiring a walker can board an airplane and still bring carry bags. These needs are met by the present invention as described and claimed below.

SUMMARY OF THE INVENTION

The present invention is a push luggage assembly that combines luggage bags with a walker assembly. The walker has a collapsible framework, wherein said walker has a first frame element, a second frame element and folding linkages that interconnect the first frame element and the second frame element. The walker also has folding leg elements that extend from the frame elements. Both the frame elements and the leg elements are supported by wheels.

Travel bags are provided that are sized to attach to the walker. A first travel bag attaches to a first set of linkages between the frame elements. A second travel bag attaches to a second set of linkages between the frame elements. that rests upon the flexible support panel. In this manner, the travel bags attach to the walker while the walker is in use. The bags can detach from the walker when the walker is folded.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention assembly can be embodied in many ways, the illustrations show only one exemplary embodiment. The exemplary embodiment is selected in order to set forth the best mode contemplated for the invention. The illustrated embodiment, however, is merely exemplary and should not be considered a limitation when interpreting the scope of the appended claims.

Figure 1:
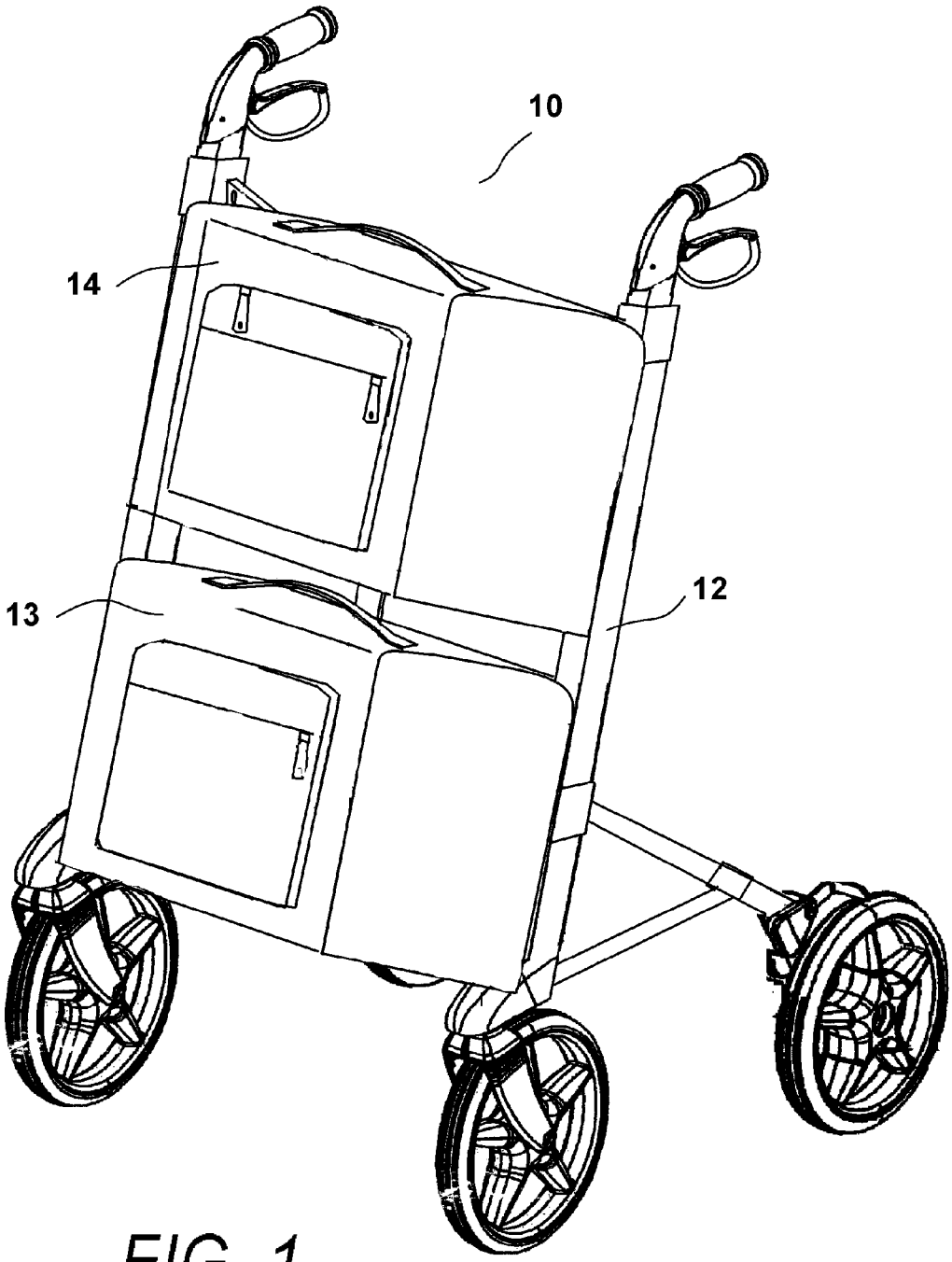
FIG. 1 is a perspective view of an exemplary embodiment of a push luggage assembly shown in an open configuration.
Figure 2:
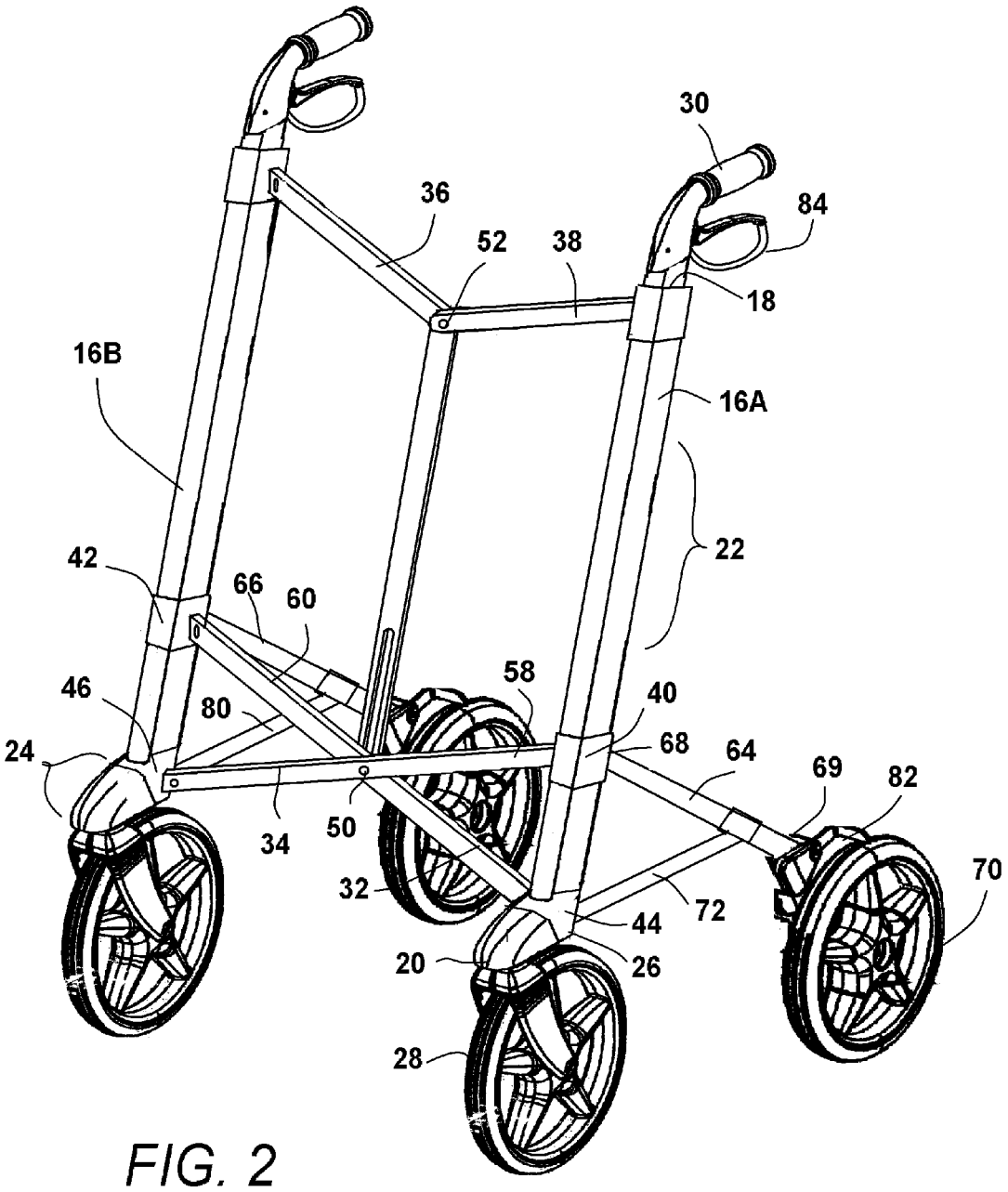
FIG. 2 is a view of the exemplary embodiment of FIG. 1 with the travel bags removed.

Referring to FIG. 1 and FIG. 2, a push luggage assembly 10 is shown that consists of a collapsible walker 12 and customized travel bags 13, 14 that are designed to be carried by the collapsible walker 12. The travel bags 13, 14 are preferably sized to be considered carry-on luggage by an airline. However, larger travel bags and luggage can be used.

The collapsible walker 12, when opened, serves two purposes. First, the collapsible walker 12 serves as a traditional walker that helps a person who is unsteady on his/her feet, to walk. Second, the collapsible walker 12 serves as a handcart that can readily transport the travel bags 13, 14 so that the travel bags 13, 14 need not be carried. In this manner, when a person walks with the collapsible walker 12, his/her hands are free to grasp the collapsible walker 12. The travel bags 13, 14 move with the collapsible walker 12.

Figure 3:
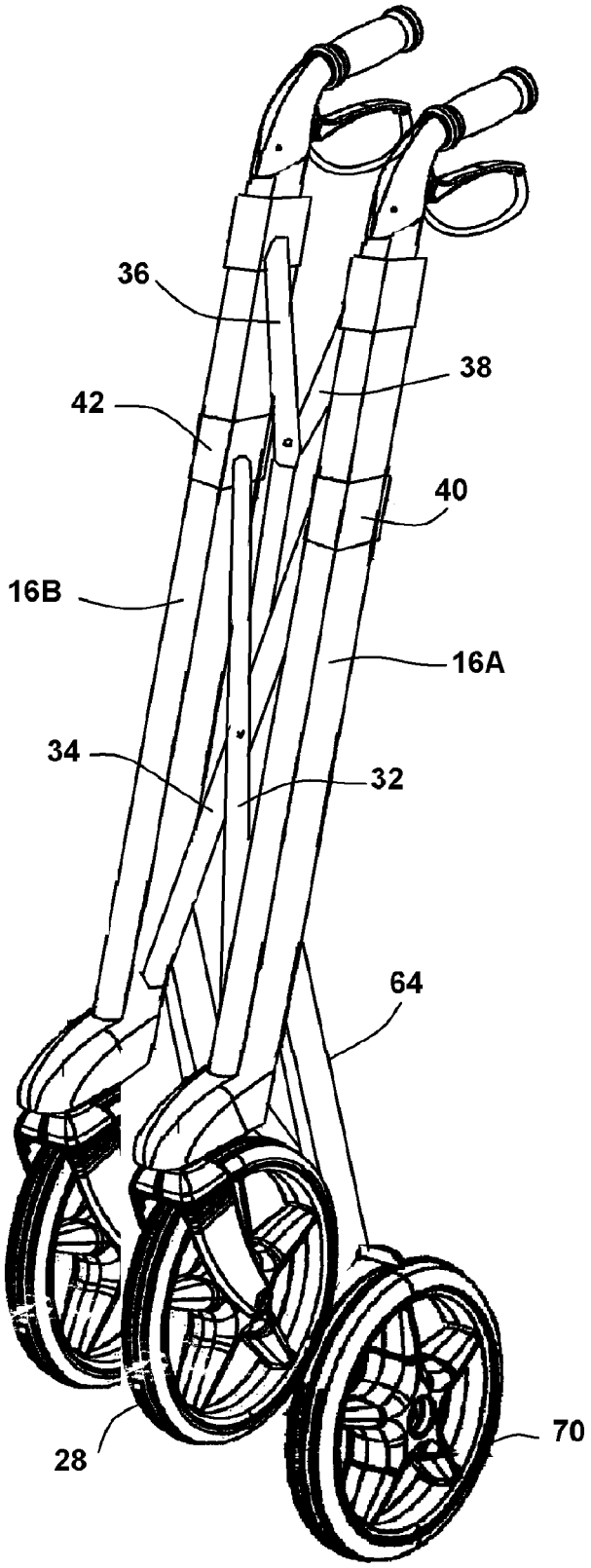
FIG. 3 is shows the walker component of the push luggage assembly in a collapsed condition.

Referring to FIG. 2 in conjunction with FIG. 3, it can be seen that the collapsible walker 12 has two primary frame elements 16A, 16B that are the mirror image of each other. Each of the primary frame elements 16A, 16B is generally L-shaped and have a first end 18 and a second end 20. Due to the L-shape of each of the primary frame elements 16A, 16B, each of the primary frame elements 16A, 16B has a long straight section 22 and a short straight section 24. The long straight section 22 and the short straight section 24 intersect at a right angle joint 26. The first end 18 is at the top of the long straight section 22. The second end 20 is the free end of the short straight section 24. Caster front wheels 28 are attached to the short straight sections 24 at the second ends 20.

Handles 30 are provided. The handles 30 can be affixed to the first end 18 of each of the primary frame elements 16A, 16B. However, it is preferred that the handles 30 engage the primary frame elements 16A, 16B with a telescoping connection. This enables the handles 30 to be adjusted to different heights above the first ends 18 of the primary frame elements 16A, 16B.

The two primary frame elements 16A, 16B are interconnected by a plurality of linkages. The linkages include a set of scissor linkages 32, 34 and a set of V-linkages 36, 38. Slides 40, 42 are attached to the long straight sections 22 of each of the primary frame elements 16A, 16B. The slides 40, 42 are free to move back and forth along each of the long straight sections 22. Anchor mounts 44, 46 are also attached to the primary frame elements 16A, 16B near the right angle joint 26. The anchor mounts 44, 46 are set at fixed positions. The first scissor linkage 32 extends from the anchor mount 44 of the first primary frame element 16A to the slide 42 on the second primary frame element 16B. Conversely, the second scissor linkage 34 extends from the anchor mount 46 on the second primary frame element 16B to the slide 40 on the first primary frame element 16A. The two scissor linkages 32, 34 connect to the anchor mounts 44, 46 and the slides 40, 42 with pivot connections. Furthermore, the two scissor linkages 32, 34 are joined in the middle at a central pivot connection 50.

The first V linkage 36 attaches to the first primary frame element 16A near its first end 18. Likewise, the second V linkage 38 attaches to the second primary frame element 16B near its second end 20. The two V linkages 36, 38 interconnect between the two primary frame elements 16A, 16B with a central pivot connection 52. A vertical slave linkage 54 is provided. The vertical slave linkage 54 extends between the central pivot connection 52 of the V linkages 36, 38 and the central pivot connection 50 of the scissor linkages 32, 34. The vertical slave linkage 54 is pivotally connects to the central pivot connection 52 between the two V linkages 36, 38. A slot 56 is formed in the vertical slave linkage 54. The central pivot connection 50 between the scissor linkages 32, 34 engages the slot 56 of the vertical slave linkage 54. In this manner, the central pivot connection 50 between the scissor linkages 32, 34 can move along the slot 56 relative the vertical slave linkage 54 without disengaging the slot 56. The purpose of the slave linkage 56 is to ensure that the V linkages 36, 38 and the scissor linkages 32, 34 move in unison.

When the collapsible walker 12 is fully open, it can be seen that the first scissor linkage 32 has a first inclined section 58 that extends between the central pivot connection 50 and the first slide 40. This first inclined section 58 is parallel to the first V linkage 36. Likewise, the second scissor linkage 34 has an inclined section 60 that extends between the central pivot connection 50 and the second slide 42. This second inclined section 60 is parallel to the second V linkage 38. The inclined sections 58, 60 of the scissor linkages 32, 34 and the V linkages 36, 38 are inclined at a descending angle as they approach the vertical slave linkage 54. The inclined sections 58, 60 of the scissor linkages 32, 34 and the V linkages 36, 38 are used as mounting surfaces, as will later be explained.

Two folding legs 64, 66 are provided. The first folding leg 64 has a first end 68 that attaches to the slide 40 on the first primary frame element 16A. The first folding leg 64 has a second end 69 that terminates with a rear wheel 70. A linkage arm 72 extends from the anchor mount 44 on the first primary frame element 16A to the first folding leg 64. The linkage arm 72 connects to both the anchor mount 44 and the folding leg 64 at pivot connections.

The second folding leg 66 has a first end that attaches to the slide 42 on the second primary frame element 16B. The second folding leg 66 has a second end that terminates with another rear wheel 70. A linkage arm 80 extends from the anchor mount 46 on the second primary frame element 16B to the second folding leg 66. The linkage arm 80 connects to both the anchor mount 45 and the folding leg 66 at pivot connections.

A mechanical brake mechanism 82 is provided for the rear wheels 70 on the two folding legs 64, 66. Levers 84 are connected to the handles 30 of the primary frame elements 16A, 16B. When the levers 84 are engaged, they pull upon cables. The cables pull brake actuators 88 against the rear wheels 70 and prevent the rear wheels 70 from turning.

The collapsible walker 12 of the push luggage assembly 10 can be selectively configured into either a collapsed configuration or an open configuration. The open configuration is shown in FIG. 1 and FIG. 2. In this open configuration, the two primary frame elements 16A, 16B are moved apart to the further distance enabled by the scissor linkages 32, 34 and the V linkages 36, 38. This causes the slides 40, 42 to move to their lowest points on the primary frame elements 16A, 16B as they are moved by the scissor linkages 32, 34. As the slides 40, 42 move downwardly, they cause the folding legs 54, 56 to extend. Once the folding legs 54, 56 are extended, the walker 12 is in its open configuration.

The closed configuration is shown in FIG. 3. In the closed configuration, the two primary frame elements 16A, 16B are moved together to the closest distance enabled by the scissor linkages 32, 34 and the V linkages 36, 38. This causes the slides 40, 42, to move to their highest points on the primary frame elements 16A, 16B by the scissor linkages 32, 34. As the slides 40, 42 move upwardly, they cause the folding legs 64, 66 to retract. Once the folding legs 64, 66 are retracted, the collapsible walker 12 is in its closed configuration.

Figure 4:
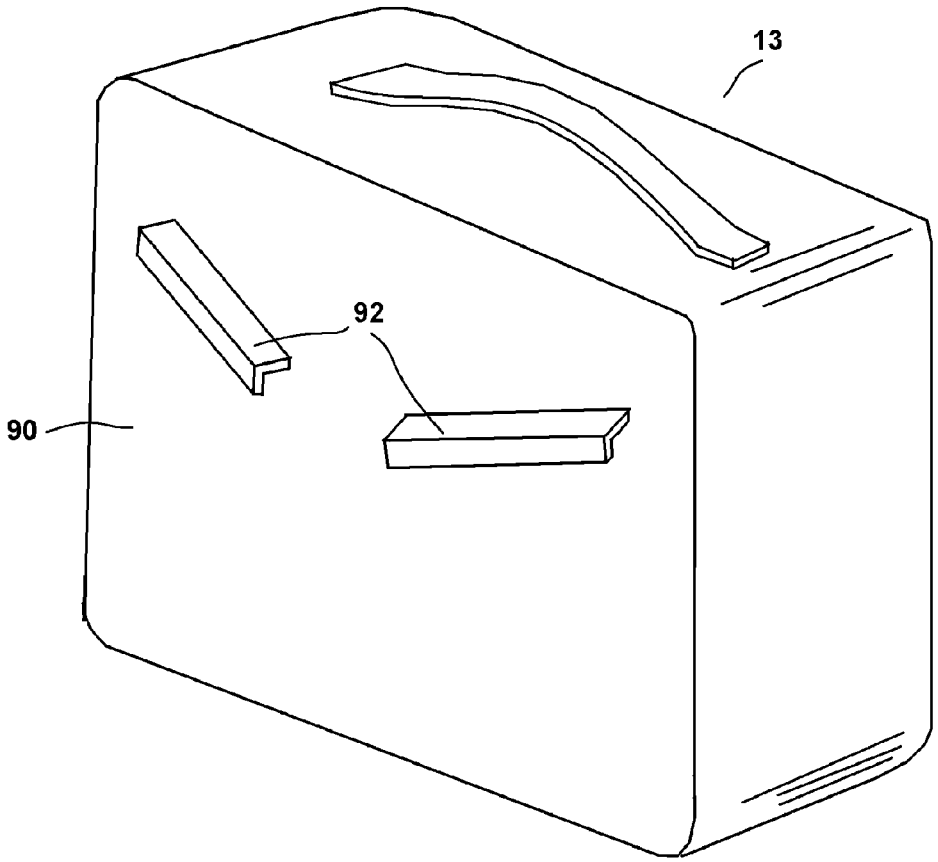
FIG. 4 is shows the back plate of a travel bag.
Figure 5:
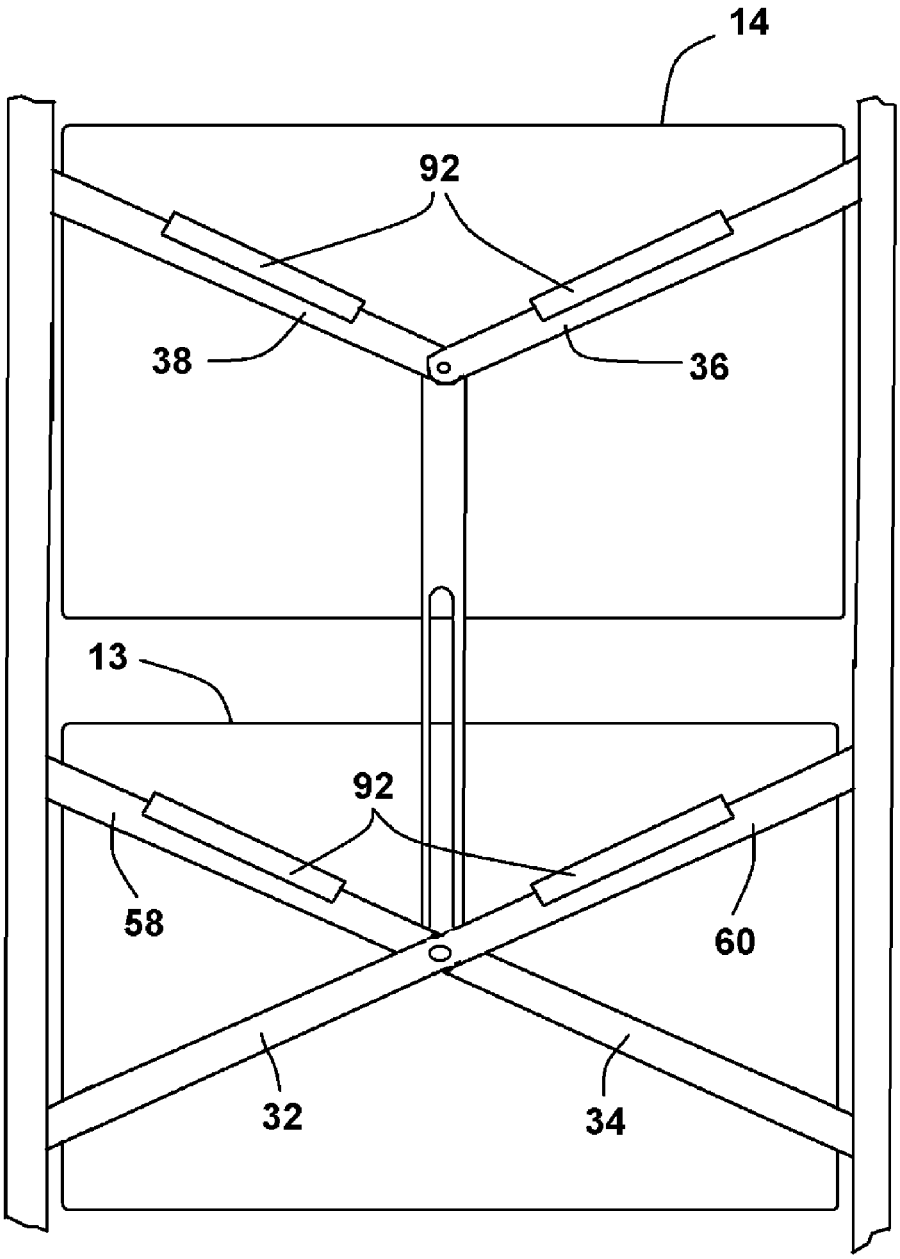
FIG. 5 shows the interconnection between the back plate of FIG. 4 and the linkages of the walker.

Referring to FIG. 4 and FIG. 5 in conjunction with FIG. 1 and FIG. 2, it can be seen that each of the travel bags 13, 14 has a back plate 90. The back plate 90 can be manufactured into the travel bags 13, 14 or can be retroactively added to existing travel bags. Hook connectors 92 extend outwardly from the back plates 90. The hook connectors 92 are spaced and inclined so that they align with the V linkages 36, 38 and the inclined sections 58, 60 of the scissor linkages 32, 34. The hook connectors 92 engage the V linkages 36, 38 and the inclined sections 58, 60 of the scissor linkages 32, 34. This mechanically interconnects the travel bags 13, 14 to the collapsible walker 12. The slope of the hook connector 92 also acts to automatically center the travel bags 13, 14 on the collapsible walker 12. To remove a travel bag 13, 14 from the collapsible walker 12, the travel bag 13, 14 is merely lifted upwardly so that the hook connectors 92 disengage the linkages. Although hook connectors 92 are illustrated, it will be understood that other mechanical connectors can be used to connect the travel bags 13, 14 to the linkages. Other mechanical connectors, such as snaps, hook and loop connections and the like can be used provided the mechanical connection can be easily undone by hand.

Referring to all figures, it will be understood that in order to utilize the push luggage assembly 10, the collapsible walker 12 is unfolded into its open configuration. The travel bags 13, 14 are attached to the walker 12 by engaging the hook connector 92 on the travel bags 13, 14 with the V linkages 36, 38 and scissor linkages 32, 34 of the collapsible walker 12. The collapsible walker 12 can then be used in the manner of a traditional walker with a person grasping the handles 30 and walking in the gap space between the handles 30. As a person walks with the collapsible walker 12, the travel bags 13, 14 are automatically transported as part of the push luggage assembly 10.

Once a person walks onto an airplane, the travel bags 13, 14 can be disconnected from the collapsible walker 12 and placed into overhead luggage compartments. The collapsible walker 12 itself is then closed into its collapsed configuration. In the collapsed configuration, the walker 12 is small enough to be checked with the flight crew.

It will be understood that the embodiment of the push luggage assembly that is illustrated and described is merely exemplary and that a person skilled in the art can make many variations to that embodiment. All such embodiments are intended to be included within the scope of the present invention as defined by the claims.

What is claimed is:

1. A combined luggage bag and walker assembly, comprising:

a walker having a collapsible framework, wherein said walker has a first frame element, a second frame element and linkages that extends between said first frame element and said second frame element, wherein said linkages include scissor linkages and V linkages;

a first travel bag having a back plate and hooked connectors that extend from said back plate, wherein said hooked connectors engage said scissor linkages and mechanically interconnect said first travel bag to said collapsible framework to prevent said first travel bag from inadvertently falling from said walker; and a second travel bag that engages said V linkages to mechanically interconnect said second travel bag to said collapsible framework and prevent said second travel bag from inadvertently falling from said walker.

2. The assembly according to claim 1, wherein said linkages are inclined at angles that bias said hook connectors toward a central position between said first frame element and said second frame element.

3. The assembly according to claim 1, wherein said walker is supported by wheels that enable said walker to roll.

4. The assembly according to claim 1, wherein said scissor linkages enable said first frame element to abut against said second frame element when said walker is in a collapsed configuration and holds said second frame element away from said first frame element when in an open configuration.

5. The assembly according to claim 1, wherein said scissor linkages and said V linkages are interconnected by a slave linkage.

6. The assembly according to claim 1, wherein said walker further includes leg extensions that extend from said first frame element and said second frame element, wherein said leg extensions selectively fold against said first frame element and said second frame element.

7. A combined luggage bag and walker assembly, comprising:

two frame elements, wherein each of said frame elements has a first end and a second end;

forward wheels, wherein one of said forward wheels is affixed to said second end of each of said frame elements;

slides that move reciprocally along said frame elements;

handles coupled to said first end of said frame elements;

two leg elements that terminate with rearward wheels, wherein said leg elements are pivotably connected to said slides;

linkages disposed between said frame elements and said slides, wherein said linkages include both scissor linkages and V linkages;

a first luggage bag having mechanical connectors that engage said linkages and enable said luggage bag to be selectively attached and removed from said scissor linkages; and a second luggage bag that connects to said V linkages.

8. The assembly according to claim 7, wherein said first luggage bag has a back plate and said mechanical connectors are hook elements that extend from said back plate.

9. The assembly according to claim 8, wherein said linkages are inclined at angles that bias said hook connectors toward a central position between said frame elements.

10. A combined luggage bag and walker assembly, comprising:

two frame elements supported by front wheels;

two legs supported by rear wheels;

slides that move reciprocally on said frame elements, wherein said two legs are connected to said slides with pivot connections;

scissor linkages disposed between said frame elements and said slides;

V linkages that extend between said frame elements;

a first travel bag having hook connectors that hook onto said scissor linkages; and a second travel bag that hooks onto said V linkages.

11. The assembly according to claim 10, further including handles that extend from said frame elements.

* * * * *